US005790069A

United States Patent [19]

McDaniel et al.

[11] Patent Number: 5,790,069

[45] Date of Patent: Aug. 4, 1998

[54] THERMAL PROCESSOR WITH AIR FLOW PREVENTING STRUCTURE

[75] Inventors: David J. McDaniel, Minneapolis; John J. Allen, Mendota Heights; Robert M. Biegler, Woodbury, all of Minn.

[73] Assignee: Imation Corp., Oakdale, Minn.

[21] Appl. No.: 540,094

[22] Filed: Oct. 6, 1995

[51] Int. Cl.[6] ..... B41J 2/47

[52] U.S. Cl. ..... 347/263; 347/156; 399/222

[58] Field of Search ..... 347/263, 262, 347/264, 155, 156; 399/67, 222, 252, 320

[56] References Cited

U.S. PATENT DOCUMENTS

| | | | |
|---|---|---|---|
| 3,436,523 | 4/1969 | Umahashi | 219/216 |
| 3,757,662 | 9/1973 | Ingels | 95/89 |
| 5,023,654 | 6/1991 | Matsumoto et al. | 355/27 |
| 5,565,034 | 10/1996 | Nanbu et al. | 116/668 |

*Primary Examiner*—Mark J. Reinhart
*Attorney, Agent, or Firm*—William K. Weimer

[57] ABSTRACT

A thermal processor includes an air flow preventing means that substantially prevents the flow of air from a processor exit into a thermal processing compartment. The prevention of air flow reduces processing defects that otherwise could occur in sheets of thermally processed material handled by the thermal processor. The reduction of processing defects enhances the quality of the sheet of thermally processed material. In particular, the reduction of processing defects can enhance image quality of a sheet of photothermographic imaging material. The prevention of air flow reduces processing defects by maintaining a substantially uniform temperature within a thermal processing compartment of the thermal processor, and by reducing the condensation of fatty acids on interior surfaces of the thermal processing compartment prior to filtration.

25 Claims, 2 Drawing Sheets

THERMAL PROCESSOR WITH AIR FLOW PREVENTING STRUCTURE

FIELD OF THE INVENTION

The present invention is generally directed to thermal processing technology and, more particularly, to techniques for processing sheets of thermally processed material with reduced defects.

DISCUSSION OF RELATED ART

Sheets of thermally processed material are widely used in a variety of applications. For example, various medical, industrial, and graphic imaging applications use sheets of photothermographic material to produce high-quality images. Sheets, as used in this description, may refer, for example, to short segments, longer lengths, or continuous rolls of photothermographic material. The photothermographic material is photographically exposed to form a latent image. A thermal processor then thermally develops the latent image to form a visible image.

The thermal processor heats the sheet to at least a threshold temperature for a period of time. The thermal processor may include, for example, a heated drum and a plurality of rollers mounted within a thermal processing compartment. The rollers transport sheets of photothermographic material from an entrance, along the drum, and to an exit. A sheet of photothermographic material typically includes a base side and an emulsion side. During thermal processing, the heated emulsion produces gasses containing fatty acids. To prevent emission of the fatty acids, the thermal processor may include an air filtration compartment. The air filtration compartment captures the fatty acids prior to emission of the gasses from the thermal processor.

The air filtration compartment may include a blower that draws air from the thermal processing compartment to a filter device. The current created by the blower can draw cool air into the film processing compartment via the sheet exit. The introduction of cool air into the film processing compartment is undesirable. The cool air can contact the heated sheet of photothermographic material as the sheet exits the thermal processor. The cool air causes uneven cooling that can result in visible defects in the sheet such as streaks and/or spots. The cool air also can reduce the temperature within the thermal processing compartment. The reduced temperature alters the thermal development profile for the sheet of photothermographic material, and enables fatty acids to condense on interior surfaces of the thermal processing compartment prior to filtration.

In view of the undesirability of the introduction of cool air into the thermal processing compartment of a thermal processor, there is a need for an improved thermal processor that avoids such introduction of cool air.

SUMMARY OF THE INVENTION

The present invention is directed to a thermal processor having an air flow preventing means for substantially preventing flow of air from the exit to a thermal processing compartment of the thermal processor, and to an imaging system incorporating such a thermal processor. The prevention of air flow reduces processing defects that otherwise could occur in sheets of thermally processed material handled by the thermal processor. The reduction of processing defects enhances the quality of the sheet of thermally processed material. In particular, the reduction of processing defects can enhance image quality of a sheet of photothermographic imaging material. The prevention of air flow reduces processing defects by maintaining a substantially uniform temperature within the thermal processing compartment, and by reducing the condensation of fatty acids on interior surfaces of the thermal processing compartment prior to filtration.

In accordance with the present invention, the thermal processor comprises a processor housing, a thermal processing compartment within the processor housing, a heating element within the thermal processing compartment, a transport mechanism within the processor housing, the transport mechanism transporting the sheets of thermally processed material along a sheet path through the thermal processing compartment adjacent the heating element and to an exit of the housing, the heating element applying heat to the sheets of thermally processed material, an air filtration compartment having a first air intake receiving air from the thermal processing compartment and a second air intake receiving air from the exit of the housing, and an air flow preventing means for substantially preventing flow of air from the exit to the thermal processing compartment.

The advantages of the present invention will be set forth in part in the description that follows, and in part will be apparent from the description, or may be learned by practice of the present invention. The advantages of the apparatus and method of the present invention will be realized and attained by means particularly pointed out in the written description and claims, as well as in the appended drawings. It is to be understood, however, that both the foregoing general description and the following detailed description are exemplary and explanatory only, and not restrictive of the present invention, as claimed.

BRIEF DESCRIPTION OF THE DRAWINGS

The accompanying drawings are included to provide a further understanding of the present invention and are incorporated in and constitute a part of this specification. The drawings illustrate exemplary embodiments of the present invention and together with the description serve to explain the principles of the invention.

DETAILED DESCRIPTION OF THE PREFERRED EMBODIMENTS

Figure 1:
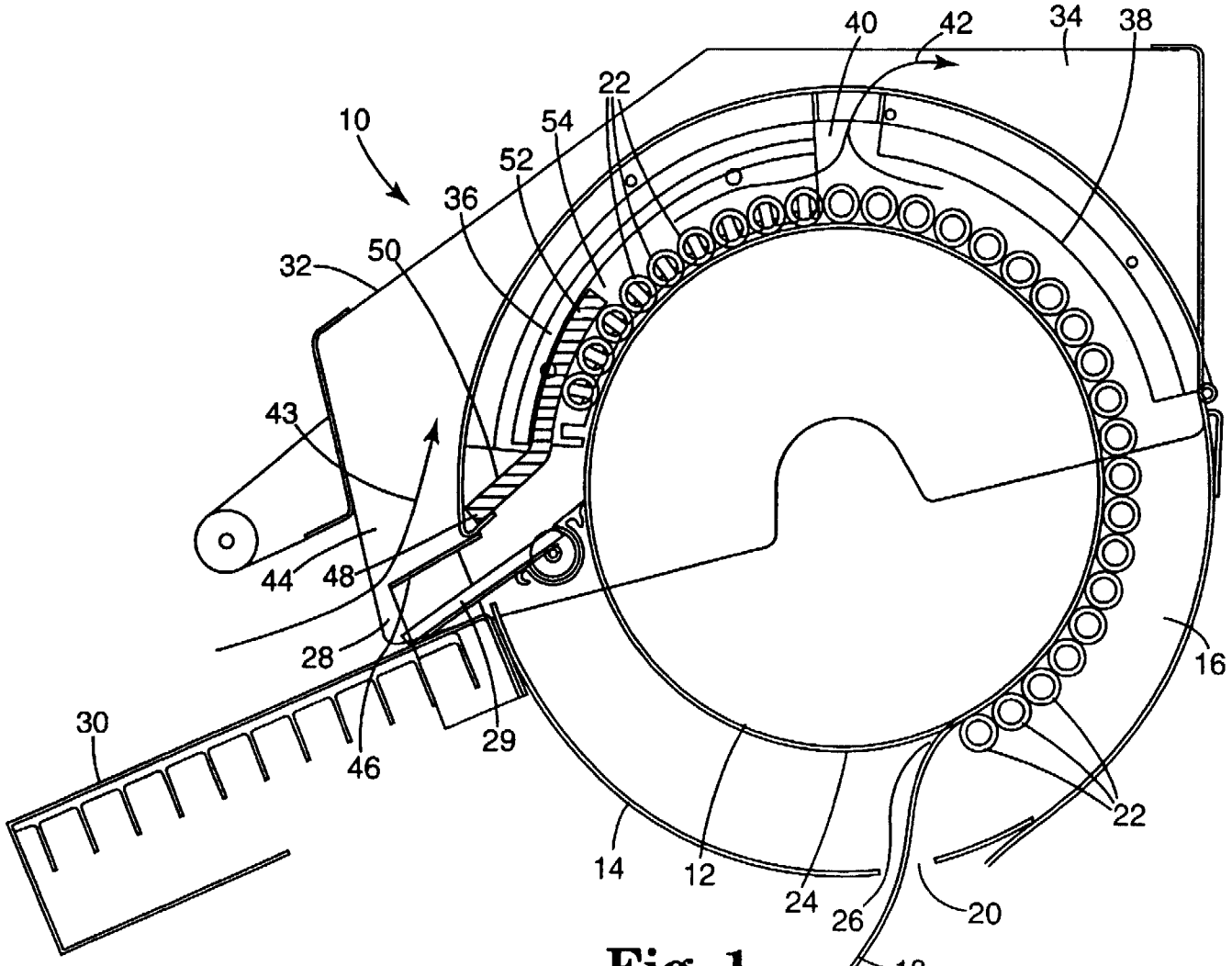
FIG. 1 is a side view of a thermal processor incorporating air flow preventing means, in accordance with the present invention.

FIG. 1 is a side view of a thermal processor 10 incorporating an air flow preventing means, in accordance with the present invention. An example of a thermal processor conforming substantially to thermal processor 10, without the air flow preventing means, is disclosed in copending and commonly assigned U.S. patent application Ser. No. 08/239,709, filed May 9, 1994, the entire content of which is incorporated herein by reference. The thermal processor 10 applies heat to a sheet of thermally processed material. The sheet of thermally processed material may be realized by a variety of formats such as, for example, short segments, longer lengths, or continuous rolls.

The sheet of thermally processed material may comprise, for example, a sheet of thermographic material and, in particular, a sheet of photothermographic material useful in the formation of images. In this case, thermal processor 10 applies heat to the sheet of photothermographic material to develop a latent image formed on the sheet. A sheet of photothermographic material may comprise a base coated with a photothermographic emulsion. The base may comprise, for example, paper, polyester film, or the like. The emulsion may comprise, for example, silver halide-based material. Examples of a suitable photothermographic material are disclosed in copending and commonly assigned U.S. patent application Ser. No. 08/072,153, filed Nov. 23, 1993, and U.S. patent application Ser. No. 08/239,984, filed May 9, 1994. The entire content of each of the above-referenced patent applications is incorporated herein by reference.

As shown in FIG. 1, thermal processor 10 includes a heating element realized, for example, by a heated drum 12. The heated drum 12 is mounted within a first housing section 14 of a processor housing. The interior of first housing section 14 defines a thermal processing compartment 16. The heated drum 12 applies heat to a sheet 18 of thermally processed material received via an entrance 20 of first housing section 14. A plurality of rollers 22 are mounted along a circumferential surface 24 of drum 12. The rollers 22 serve as a transport mechanism within first housing section 14. The rollers 22 transport sheet 18 of thermally processed material along a sheet path 26 within thermal processing compartment 16. The sheet path 26 carries sheet 18 adjacent the heating element and to an exit 28 of first housing section 14. The heated drum 12 applies heat to sheet 18 as the sheet passes along sheet path 26, thereby thermally processing the sheet. A guide plate 29 guides sheet 18 to a cooling plate 30 mounted adjacent exit 28 outside thermal processor 10. The cooling plate 30 receives sheet 18 and gradually cools the sheet for handling.

A second housing section 32 mounted on a top portion of first housing section 14 has an interior defining an air filtration compartment 34. A wall having a first wall section 36 and a second wall section 38 separate thermal processing compartment 16 from air filtration compartment 34. A first air intake 40 is provided between first wall section 36 and second wall section 38 to enable flow of a first stream 42 of air from thermal processing compartment 16 to air filtration compartment 34. A blower may be provided within air filtration compartment 34 to draw air stream 42 out of thermal processing compartment 16 and to a filter apparatus within the air filtration compartment.

The current created by the blower also draws a stream 43 of cool air from exit 28 into air filtration compartment 34 via a second air intake 44. The current also can draw cool air into film processing compartment 16 via exit 28. The introduction of cool air into film processing compartment 16 is undesirable. The cool air can contact the heated sheet 18 as the sheet exits thermal processor 10. The cool air causes uneven cooling that can result in visible defects in sheet 18 such as streaks and/or spots. The cool air also reduces the temperature within thermal processing compartment 16. The reduced temperature alters the thermal development profile for sheet 18, and enables fatty acids to condense on interior surfaces of thermal processing compartment 16 prior to filtration.

In accordance with the present invention, thermal processor 10 further comprises an air flow preventing means. The air flow preventing means substantially prevents the flow of cool air from exit 28 to thermal processing compartment 16. With reference to FIG. 1, the air flow preventing means may comprises an air flow diverting element 46 and an air flow blocking element 48. The air flow diverting element 46 is positioned outside of thermal processing compartment 16 adjacent exit 28. The air flow diverting element 46 diverts at least a portion of the flow of air from exit 28 away from thermal processing compartment 16. In particular, air flow diverting element 46 diverts the flow of air onto sheet 18 as the sheet exits thermal processor 10 via exit 28. The air flow diverting element 46 thereby prevents uneven cooling that can result in visible defects in sheet 18 such as streaks and/or spots. The air flow diverting element 46 may extend along the entire width of exit 28, and may comprise, for example, a sheet of aluminum or steel.

The air flow blocking element 48 is positioned inside thermal processing compartment 16. The air flow blocking element 48 blocks at least a portion of the flow of air from exit 28 to sheet path 26 adjacent heated drum 12. The air flow blocking element 48 is positioned such that at least a portion of the air flow blocking element is positioned between first wall section 36 and heated drum 12. In particular, air flow blocking element 48 preferably is positioned between first wall section 36 and rollers 22. As shown in FIG. 1, for example, air blocking element 48 may include a first end 50 positioned adjacent exit 28 and a second end 52 that extends into a gap 54 between first wall section 36 and rollers 22. The second end 52 of air blocking element 48 substantially fills gap 54 to prevent the movement of air from exit 28 into sheet path 26. The air blocking element 48 thereby prevents introduction of cool air that otherwise could reduce the temperature within thermal processing compartment 16, affecting processing uniformity. Consequently, air blocking element 48 helps maintain the thermal development profile for sheet 18, and avoids condensation of fatty acids on interior surfaces of thermal processing compartment 16 prior to filtration. The air blocking element 48 may extend along the entire width of drum 12 perpendicular to sheet path 26. The air blocking element 48 preferably comprises a substantially thermally insulative material such as, for example, natural felt, synthetic felt, Numax, or wool.

Figure 2:
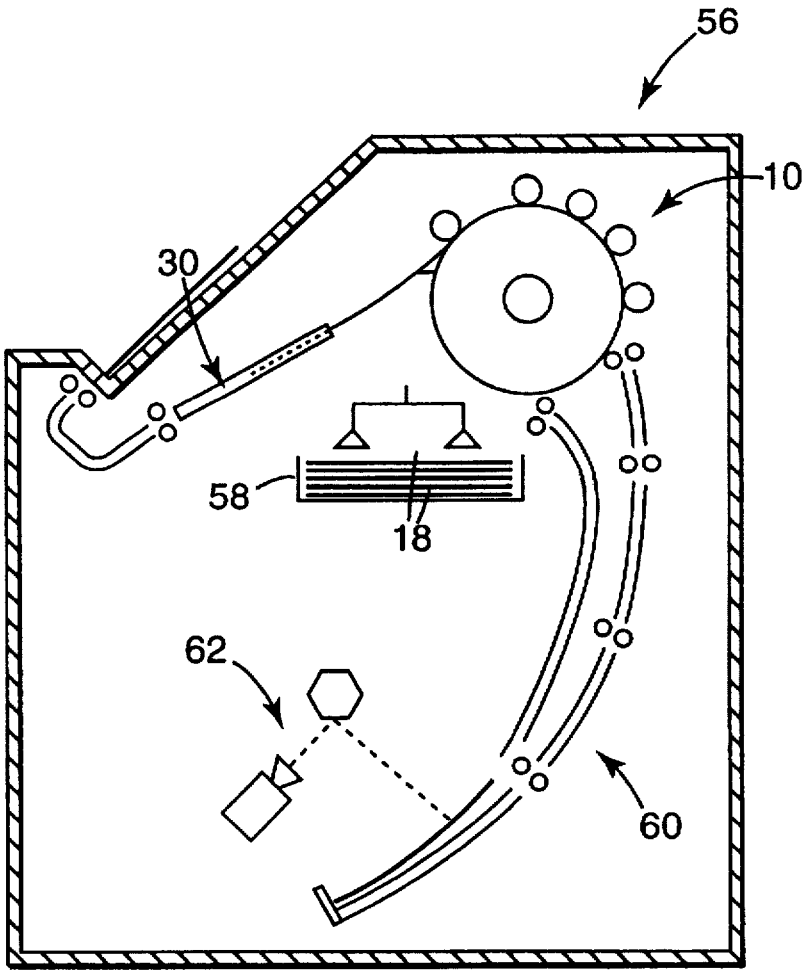
FIG. 2 is a side view of a photothermographic imager incorporating the thermal processor of FIG. 1.

The thermal processor 10 of the present invention can be incorporated in a larger apparatus, such as a photothermographic imager 56 as shown in FIG. 2. The photothermographic imager 56 can include a container 58 for holding sheets 18 of photothermographic material. A transport mechanism 60 can transport sheets 18 from container 58 to an exposure station 62 and to thermal processor 10. The exposure station 62 scans a light beam onto sheet 18 in an image-wise pattern to create a latent image in the sheet. The thermal processor 10 heats the sheet 18 to a sufficient temperature for a sufficient duration to develop the latent image in the sheet to a visible image.

Having described the exemplary embodiments of the article of the present invention, additional advantages and modifications will readily occur to those skilled in the art from consideration of the specification and practice of the invention disclosed herein. Therefore, the specification and examples should be considered exemplary only, with the true scope and spirit of the invention being indicated by the following claims.

What is claimed is:

1. A thermal developer for thermally developing latent images formed on sheets of thermally developable material, the thermal developer comprising:

a housing;

a thermal developing compartment within the housing;

a heating element within the thermal developing compartment;

a transport mechanism within the housing, the transport mechanism transporting the sheets of thermally developable material along a sheet path through the thermal developing compartment adjacent the heating element and to an exit of the housing, the heating element applying heat to the sheets of thermally developable material to develop latent images formed on the sheets; and an air flow preventing means for substantially preventing flow of air from the exit to the thermal developing compartment.

2. The thermal developer of claim 1, further comprising an air filtration compartment having a first air intake receiving air from the thermal developing compartment and a second air intake receiving air from the exit of the housing.

3. The thermal developer of claim 1, wherein the air flow preventing means comprises an air flow diverting element positioned outside of the thermal developing compartment adjacent the exit, the air flow diverting element diverting at least a portion of the flow of air from the exit away from the thermal developing compartment.

4. The thermal developer of claim 1, wherein the air flow preventing means comprises an air flow blocking element positioned inside of the thermal developing compartment.

5. The thermal developer of claim 1, wherein the air flow preventing means comprises an air flow blocking element positioned inside of the thermal developing compartment, the air flow blocking element blocking at least a portion of the flow of air from the exit to the sheet path adjacent the heating element.

6. The thermal developer of claim 5, wherein the air flow blocking element comprises a substantially thermally insulative material.

7. The thermal developer of claim 1, wherein the air flow preventing means comprises an air flow diverting element positioned outside of the thermal developing compartment adjacent the exit, the air flow diverting element diverting at least a portion of the flow of air from the exit away from the thermal developing compartment, and an air flow blocking element positioned inside of the thermal developing compartment, the air flow blocking element blocking at least a portion of the flow of air from the exit to the sheet path adjacent the heating element.

8. The thermal developer of claim 1, wherein the thermal developing compartment includes a wall, and the air flow preventing means comprises an air flow blocking element positioned inside of the thermal developing compartment, at least a portion of the air flow blocking element being positioned between the wall and the heating element, wherein the air flow blocking element blocks at least a portion of the flow of air from the exit to the sheet path adjacent the heating element.

9. The thermal developer of claim 1, wherein the air flow preventing means comprises an air flow diverting element positioned outside of the thermal developing compartment adjacent the exit, the air flow diverting element diverting at least a portion of the flow of air from the exit away from the thermal developing compartment, and an air flow blocking element positioned inside of the thermal developing compartment, wherein the thermal developing compartment includes a wall, and the air flow blocking element is positioned between the wall and the heating element, wherein the air flow blocking element blocks at least a portion of the flow of air from the exit to the sheet path adjacent the heating element.

10. The thermal developer of claim 1, wherein the sheet of thermally developable material is a sheet of photothermographic material.

11. The thermal developer of claim 10, wherein the air flow preventing means prevents flow from the exit to the thermal developing compartment of an amount of air sufficient to avoid excessive condensation on an interior of the thermal developing compartment of fatty acids generated by the sheet of photothermographic material.

12. A system for forming a visible image on a sheet of photothermographic material, the system comprising:

a housing having an entrance for receiving a sheet of photothermographic material;

a first transport mechanism, positioned within the housing, for transporting the sheet of photothermographic material within the housing;

an exposure station positioned within the housing, the exposure station receiving the sheet of photothermographic material from the transport means and exposing the sheet of photothermographic material to an imagewise pattern of light to create a latent image on the sheet of photothermographic material;

a thermal developer positioned within the housing, the thermal developer including:

a housing, a thermal developing compartment within the housing, a heating element within the thermal developing compartment, a second transport mechanism within the housing, the transport mechanism transporting the sheets of photothermographic material along a sheet path through the thermal developing compartment adjacent the heating element and to an exit of the housing, the heating element applying heat to the sheet of photothermographic material to develop a latent image formed on the sheet, and an air flow preventing means for substantially preventing flow of air from the exit to the thermal developing compartment.

13. The system of claim 12, wherein the thermal developer further comprises an air filtration compartment having a first air intake receiving air from the thermal developing compartment and a second air intake receiving air from the exit of the housing.

14. The system of claim 12, wherein the air flow preventing means comprises an air flow diverting element positioned outside of the thermal developing compartment adjacent the exit, the air flow diverting element diverting at least a portion of the flow of air from the exit away from the thermal developing compartment.

15. The system of claim 12, wherein the air flow preventing means comprises an air flow blocking element positioned inside of the thermal developing compartment.

16. The system of claim 12, wherein the air flow preventing means comprises an air flow blocking element positioned inside of the thermal developing compartment, the air flow blocking element blocking at least a portion of the flow of air from the exit to the sheet path adjacent the heating element.

17. The system of claim 16, wherein the air flow blocking element comprises a substantially thermally insulative material.

18. The system of claim 12, wherein the air flow preventing means comprises an air flow diverting element positioned outside of the thermal developing compartment adjacent the exit, the air flow diverting element diverting at least a portion of the flow of air from the exit away from the thermal developing compartment, and an air flow blocking element positioned inside of the thermal developing compartment, the air flow blocking element blocking at least a portion of the flow of air from the exit to the sheet path adjacent the heating element.

19. The system of claim 12, wherein the thermal developing compartment includes a wall, and the air flow preventing means comprises an air flow blocking element positioned inside of the thermal developing compartment, at least a portion of the air flow blocking element being positioned between the wall and the heating element, wherein the air flow blocking element blocks at least a portion of the flow of air from the exit to the sheet path adjacent the heating element.

20. The system of claim 12, wherein the air flow preventing means comprises an air flow diverting element positioned outside of the thermal developing compartment adjacent the exit, the air flow diverting element diverting at least a portion of the flow of air from the exit away from the thermal developing compartment, and an air flow blocking element positioned inside of the thermal developing compartment, wherein the thermal developing compartment includes a wall, and the air flow blocking element is positioned between the wall and the heating element, wherein the air flow blocking element blocks at least a portion of the flow of air from the exit to the sheet path adjacent the heating element.

21. The system of claim 12, wherein the air flow preventing means prevents flow from the exit to the thermal developing compartment of an amount of air sufficient to avoid excessive condensation on an interior of the thermal developing compartment of fatty acids generated by the sheet of photothermographic material.

22. A thermal developer for thermally developing latent images formed on sheets of thermally developable material, the thermal developer comprising:

a housing;

a thermal developing compartment within the housing;

a heating element within the thermal developing compartment;

a transport mechanism within the housing, the transport mechanism transporting the sheets of thermally developable material along a sheet path through the thermal developing compartment adjacent the heating element and to an exit of the housing, the heating element applying heat to the sheets of thermally developable material to develop latent images formed on the sheets; and an air flow preventing mechanism that substantially prevents flow of air from the exit to the thermal developing compartment.

23. The thermal developer of claim 22, wherein the air flow preventing mechanism includes an air flow diverting element positioned outside of the thermal developing compartment adjacent the exit, the air flow diverting element diverting at least a portion of the flow of air from the exit away from the thermal developing compartment.

24. The thermal developer of claim 22, wherein the air flow preventing means comprises an air flow blocking element positioned inside of the thermal developing compartment, the air flow blocking element blocking at least a portion of the flow of air from the exit to the sheet path adjacent the heating element.

25. The thermal developer of claim 22, wherein the air flow preventing mechanism includes an air flow diverting element positioned outside of the thermal developing compartment adjacent the exit, the air flow diverting element diverting at least a portion of the flow of air from the exit away from the thermal developing compartment, and an air flow blocking element positioned inside of the thermal developing compartment, wherein the thermal developing compartment includes a wall, and the air flow blocking element is positioned between the wall and the heating element, wherein the air flow blocking element blocks at least a portion of the flow of air from the exit to the sheet path adjacent the heating element.

* * * * *